US007144106B2

(12) United States Patent
Ishii et al.

(10) Patent No.: US 7,144,106 B2
(45) Date of Patent: Dec. 5, 2006

(54) FIXED MATERIAL TRANSPORTATION APPARATUS AND LIQUID FIXING APPARATUS USING THE TRANSPORTATION APPARATUS

(75) Inventors: Takayuki Ishii, Nagano (JP); Yoshitaka Shimada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/272,285

(22) Filed: Oct. 17, 2002

(65) Prior Publication Data

US 2003/0084811 A1 May 8, 2003

(30) Foreign Application Priority Data

Oct. 17, 2001 (JP) ..... P2001-319516
Feb. 22, 2002 (JP) ..... P2002-046991

(51) Int. Cl.
*B41J 11/08* (2006.01)
*B41J 2/01* (2006.01)
*B41J 11/02* (2006.01)
*B65H 5/22* (2006.01)

(52) U.S. Cl. ..... 347/104; 400/656; 400/578

(58) Field of Classification Search ..... 400/662, 400/708, 578, 627; 347/30
See application file for complete search history.

(56) References Cited

U.S. PATENT DOCUMENTS 4,437,659 A 3/1984 Caron et al.
5,601,629 A * 2/1997 Helbing ..... 65/529
5,832,826 A 11/1998 Mack et al.
5,874,979 A * 2/1999 Ohyama ..... 347/104
6,038,776 A * 3/2000 Yamada et al. ..... 33/18.1
6,043,836 A 3/2000 Kerr et al.
6,048,120 A * 4/2000 Kerr ..... 400/662
6,172,741 B1 1/2001 Wotton et al.
6,196,672 B1 * 3/2001 Ito et al. ..... 347/88
6,254,090 B1 * 7/2001 Rhodes et al. ..... 271/276
6,254,092 B1 * 7/2001 Yraceburu et al. ..... 271/276
6,270,215 B1 * 8/2001 Miyasaka et al. ..... 347/104
6,454,478 B1 * 9/2002 Wotton et al. ..... 400/656
6,511,172 B1 * 1/2003 Tanno et al. ..... 347/104
6,517,179 B1 * 2/2003 Hinojosa et al. ..... 347/16

FOREIGN PATENT DOCUMENTS

JP 63-303781 12/1988
JP 03-000270 1/1991
JP 5-105260 4/1993
JP 6-143705 5/1994

(Continued)

OTHER PUBLICATIONS

Machine translation of JP 09220837 from Japanese Patent Office website.*

*Primary Examiner*—Daniel J. Colilla
(74) *Attorney, Agent, or Firm*—Sughrue Mion, PLLC

(57) ABSTRACT

To prevent cockling occurring in a fixed material in a liquid fixing apparatus more effectively and make a paper gap small thereby to improve print quality. On a fixed material transporting surface, a through hole corresponding to a sucking hole is formed, further a recess functioning as a suction chamber is formed, and a through hole is formed in this recess. When intake is performed by the suction unit, and a fixed material is transported on a fixed material transporting surface, the fixed material is sucked and supported on the transporting surface. Sequentially, when the fixed material is fixed, cockling of the fixed material is sucked into the recess by the sucking hole of the suction chamber that is the recess, so that paper rising is prevented.

15 Claims, 9 Drawing Sheets

FOREIGN PATENT DOCUMENTS

| | | | | |
|---|---|---|---|---|
| JP | H08-156351 | A | | 6/1996 |
| JP | 09220837 | A | * | 8/1997 |
| JP | H10/268676 | A | | 10/1998 |
| JP | 11-208045 | A | | 8/1999 |
| JP | 2000-191175 | | | 7/2000 |
| JP | 2001-213013 | A | | 8/2001 |

* cited by examiner

FIXED MATERIAL TRANSPORTATION APPARATUS AND LIQUID FIXING APPARATUS USING THE TRANSPORTATION APPARATUS

BACKGROUND OF THE INVENTION

The present invention relates to a fixed material transportation apparatus and a liquid fixing apparatus provided with the transportation apparatus, and particularly to technology for sucking and holding a fixed material in a fixing section of a liquid fixing apparatus.

For example, in an ink jet printer, that transports, a recording medium, which is a liquid fixing apparatus, in case that an image comprising ejected many ink droplets such as a solid image is recorded on the recording medium, the recording medium absorbs a large quantity of ink and frequently expands in a wavy manner, that is, cockling is frequently caused. When this cockling is caused, the recording medium rises up, and a gap (paper gap) between the recording medium and a recording head is reduced, so that the splash distance of the ink droplet becomes uneven thereby to cause unevenness in recording, or the recording medium comes into contact with the recording head thereby to be stained.

Recently, an apparatus has been proposed, in which an uneven guide portion having absorption holes is formed on a transporting surface for the recording medium, and the recording medium is sucked through plural sucking holes (through holes) provided for convex portions by a suction pump (refer to Japanese Unexamined Patent Publication No. JP 11-208045A). This apparatus, as a unit for solving rising-up of the recording medium due to the cockling, sucks the recording medium onto a platen through the sucking holes on the convex upper surface, whereby the rising-up of the recording medium is prevented.

However, in the structure in which the sucking holes are formed in the convex portions on the transporting surface to suck the recording medium, only a part of cockling occurring over the whole of the recording medium in a recording section is sucked, and the suction force is also low. Therefore, it is difficult to prevent the rising-up of the recording medium.

SUMMARY OF THE INVENTION

Therefore, an object of the invention is to prevent rising-up due to cockling of a fixed material in a liquid fixing apparatus and make setting of a proper paper gap possible thereby to make possible recording of high quality on the fixed material.

In order to achieve the object, according to the first aspect of the invention, a fixed material transportation apparatus comprises a suction unit that sucks and holds a fixed material on a fixed material transporting surface, and a fixed material transporting device that transports the fixed material on the fixed material transporting surface from the upstream side of the suction unit to the downstream side thereof, wherein plural recesses that are indented from surroundings are formed so as to be aligned in a main scanning direction on the fixed material transporting surface, an inner sucking hole is formed in the recess, and an outer sucking hole is formed between the recesses at least in the main scanning direction on the fixed material transporting surface.

By suction force of the suction unit, the fixed material is sucked and held from the fixed material transporting surface that is on the opposite side to a fixing surface. The fixed material is sucked by the outer sucking hole on the fixed material transporting surface, a bottom portion of cockling occurring in the fixed material falls into the recess on the fixed material transporting surface, and the recess is made in a closed space state by the sucking hole in the recess, whereby the fixed material is further sucked and sucked by its negative pressure. Namely, the recess is partitioned also in the sub-scanning direction thereby to become the closed space, and by raising airtightness between the fixed material and the recess, the fixed material is closely attached onto the fixed material transporting surface.

Hereby, according to the fixed material transportation apparatus in the first aspect of the invention, the shape of the cockling occurring in the fixed material can be corrected into a shape according to the shape of the suction unit, so that rising-up of the fixing material due to the cockling occurring in the fixed material can be prevented more effectively. Therefore, the proper paper gap can be set, so that recording of high quality can be performed on the fixed material.

In the fixed material transportation apparatus according to the second aspect of the invention, the recess has slanted faces descending from the fixed material transporting surface toward the bottom of the recess, and its shape becomes the shape according to a curve of the cockling occurring in the fixed material at the ink absorption time. Therefore, the airtightness between the recess and the fixed material rises, so that effect in suction becomes high and the rising-up of the fixed material due to the cockling can be prevented more effectively.

The fixed material transportation apparatus according to the third aspect of the invention is characterized by having a sucking hole in the slanted face. Hereby, since the suction effect is increased in the slanted face with which the fixed material comes into contact, the rising-up of the fixed material due to the cockling can be prevented more effectively.

The fixed material transportation apparatus according to the fourth aspect of the invention is characterized in that the recess has, in the sub-scanning direction, at least one protrusion that is lower than the fixed material transporting surface. Hereby, when the fixed material sucked and absorbed by the recess is transported and passes above the protrusion, the protrusion does not obstruct transportation of the fixed material, the rising-up of the fixed material is prevented and further the large suction force is obtained.

The fixed material transportation apparatus according to the fifth aspect of the invention is characterized in that the recess of the fixed material transporting surface is composed of a recess curved surface. Hereby, the shape of the recess fits to the shape of the cockling occurring in the fixed material, so that the airtightness between the recess and the fixed material becomes high. Therefore, the effect of suction becomes high.

The fixed material transportation apparatus according to the sixth aspect of the invention is characterized in that the sucking hole on the fixed material transporting surface is chamfered at least on its downstream side in the sub-scanning direction. Hereby, the transportation of the fixed material is not obstructed.

A liquid fixing apparatus according to the seventh aspect of the invention is characterized by having a fixed material transportation apparatus. According to this liquid fixing apparatus, the working effect in any one of the first to sixth aspects can be obtained.

BRIEF DESCRIPTION OF THE DRAWINGS

FIGS. 1A and 1B are diagrams showing the main constitution of a suction unit according to a first embodiment of the invention, in which FIG. 1A is a plan view and FIG. 1B is a sectional view taken along a ling b—b of FIG. 1A;

FIGS. 8A and 8B are schematic diagrams of a suction unit according to a sixth embodiment, in which FIG. 8A is a plan view and FIG. 8B is a sectional view taken along a ling b—b of FIG. 8A;

DESCRIPTION OF THE PREFERRED EMBODIMENTS

Referring to drawings, embodiments of an ink jet printer that transports a recording medium, which is a liquid fixing apparatus, will be described.

Figure 1A:
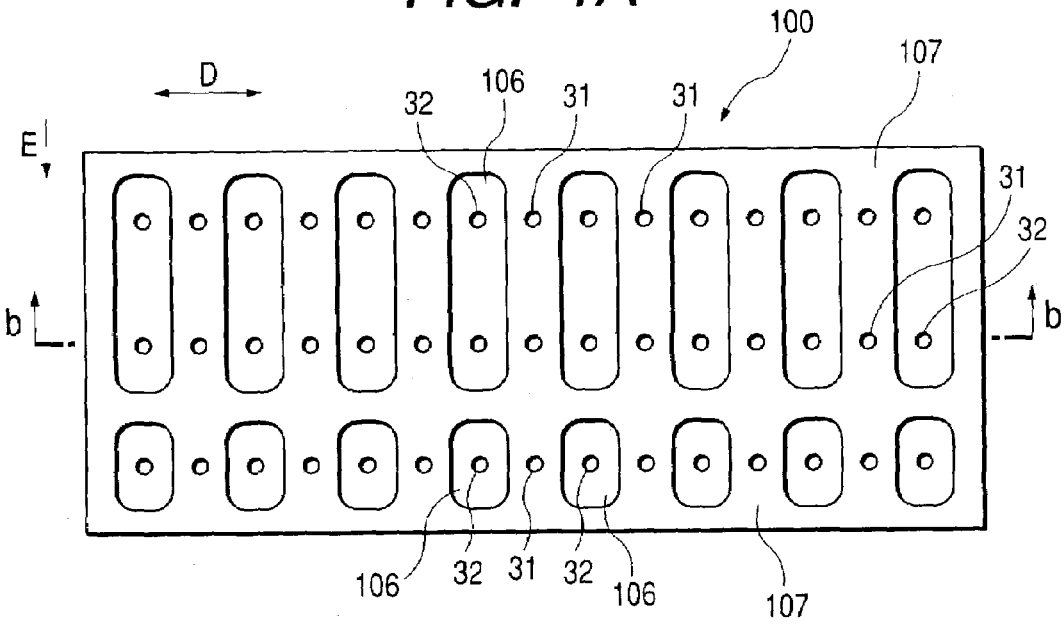
Figure 1B:
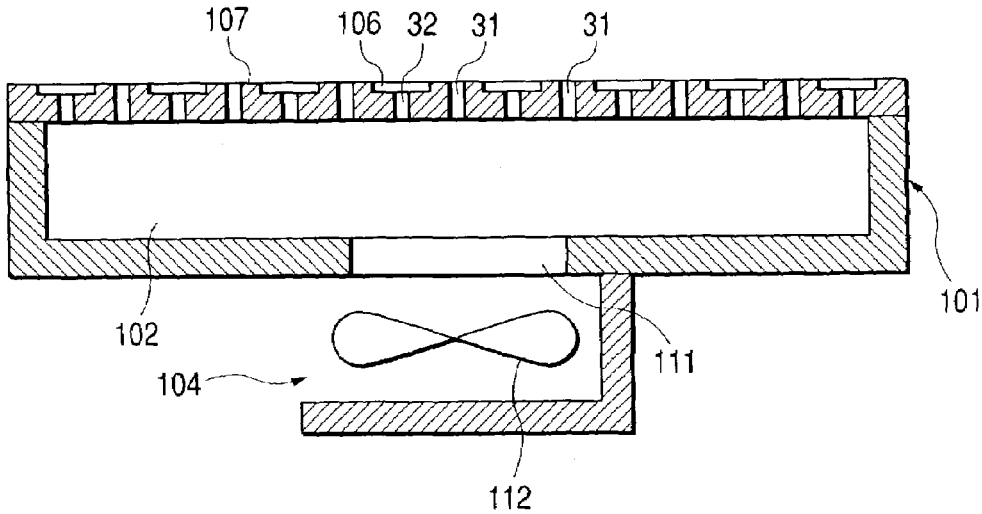

First, FIGS. 1A and 1B are diagrams showing the main constitution of a suction unit according to a first embodiment of the invention, in which FIG. 1A is its plan view and FIG. 1B is its sectional view. As shown in FIG. 1B, a suction unit 100 in this embodiment comprises a suction part 101 in an upper step and a suction force generating part 104 in a lower step, and it is formed in the shape of a hollow box. The suction part 101, as shown in FIGS. 1A and 1B, comprises a decompression chamber 102 formed inside, plural suction chambers 106 that are respectively formed in the shape of a approximately rectangular recess on a transporting surface 107 of a recording medium, and plural sucking holes 32 for communicating these suction chambers 106 respectively with the decompression chamber 102. A sucking hole 31 that corresponds to a sucking hole in the conventional suction structure and communicates the transporting surface for the recording medium and the decompression chamber 102 is formed between the recesses in the main scanning direction (in the direction D in FIGS. 1A and 1B), that is, between the adjacent suction chambers 106. The suction force generating part 104 communicates with the decompression chamber 102 of the suction part 101 through a communication hole 111, and includes a pump 112 having a centrifugal fan. Further, also in the sub-scanning direction (in the direction E in FIGS. 1A and 1B) on the transporting surface 107, the suction chambers 106, the sucking holes 32 and the sucking holes 31 can be formed similarly.

As a basic structure of this suction unit, in addition to the sucking hole 31 corresponding to the sucking hole in the conventional suction structure, the sucking hole 32 is formed in the suction chamber 106 and it is consisted of a through hole having a small diameter. Regarding cockling occurring in a recording medium at the recording, the lower portion of the cockling can be sucked by the suction chamber 106 and the sucking hole 32, and the upper portion thereof can be sucked and absorbed by the sucking hole 31, so that larger suction force can be obtained. Namely, the suction chamber 106 sucks the recording medium, whereby the recording medium is closely attached onto the transporting surface 107 surrounding the suction chamber 106, so that the suction chamber becomes a closed space, and negative pressure of its closed space gives the large suction force to the recording medium.

Next, referring to FIGS. 2 to 6, other embodiments of the invention will be described.

The basic structure of a suction unit 100 according to another embodiment is approximately similar to that in the first embodiment. Therefore, parts similar to those in the first embodiment are denoted by the same reference numerals, and their detailed description is omitted.

Working effects of suction units 100 according to other embodiments will be described below while they are being compared with those according to the first embodiment and the conventional unit.

Figure 2:
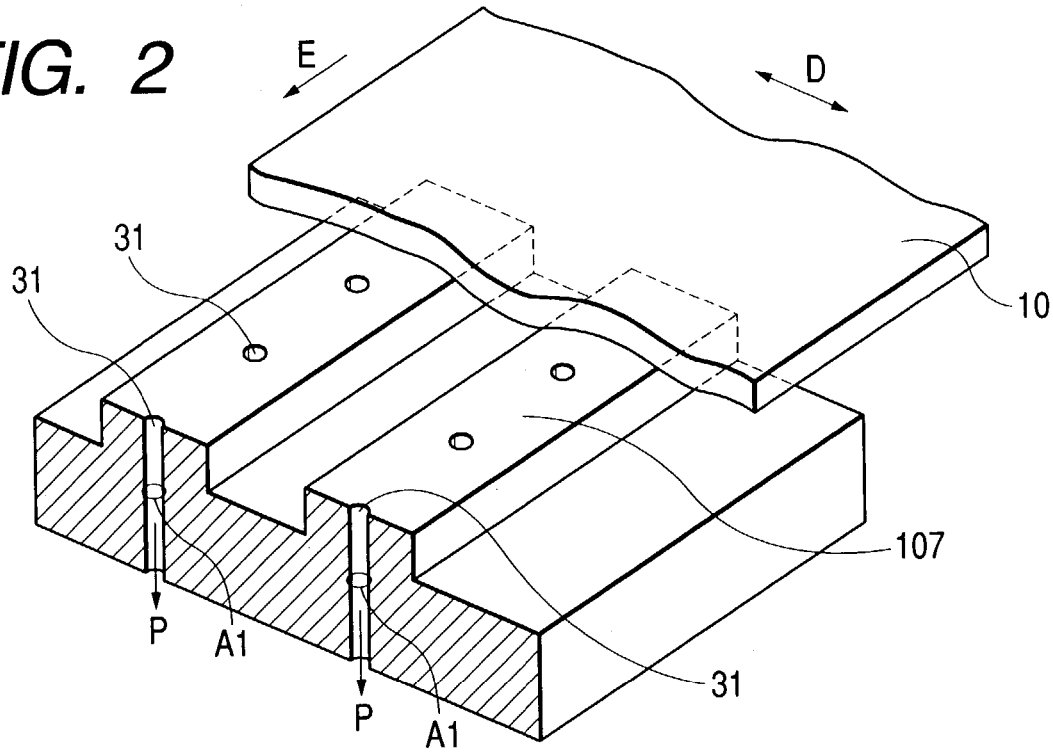
FIG. 2 is a diagram showing a working effect of a previous suction unit as a comparative example.
Figure 3:
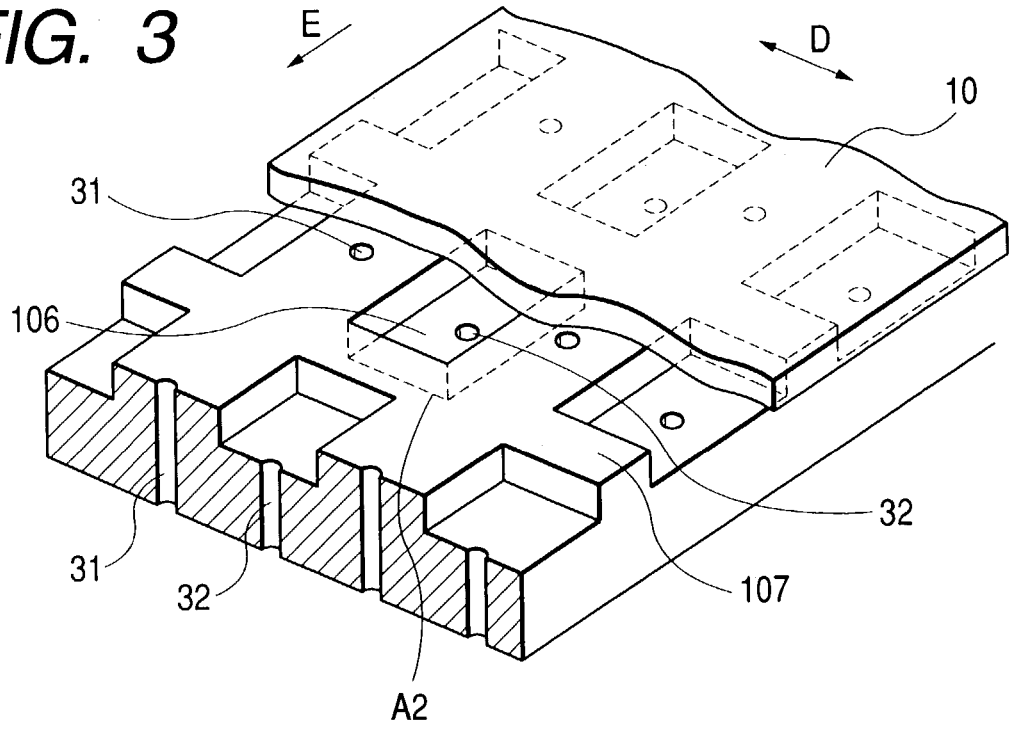
FIG. 3 is a diagram showing a working effect of the suction unit according to the first embodiment.
Figure 4:
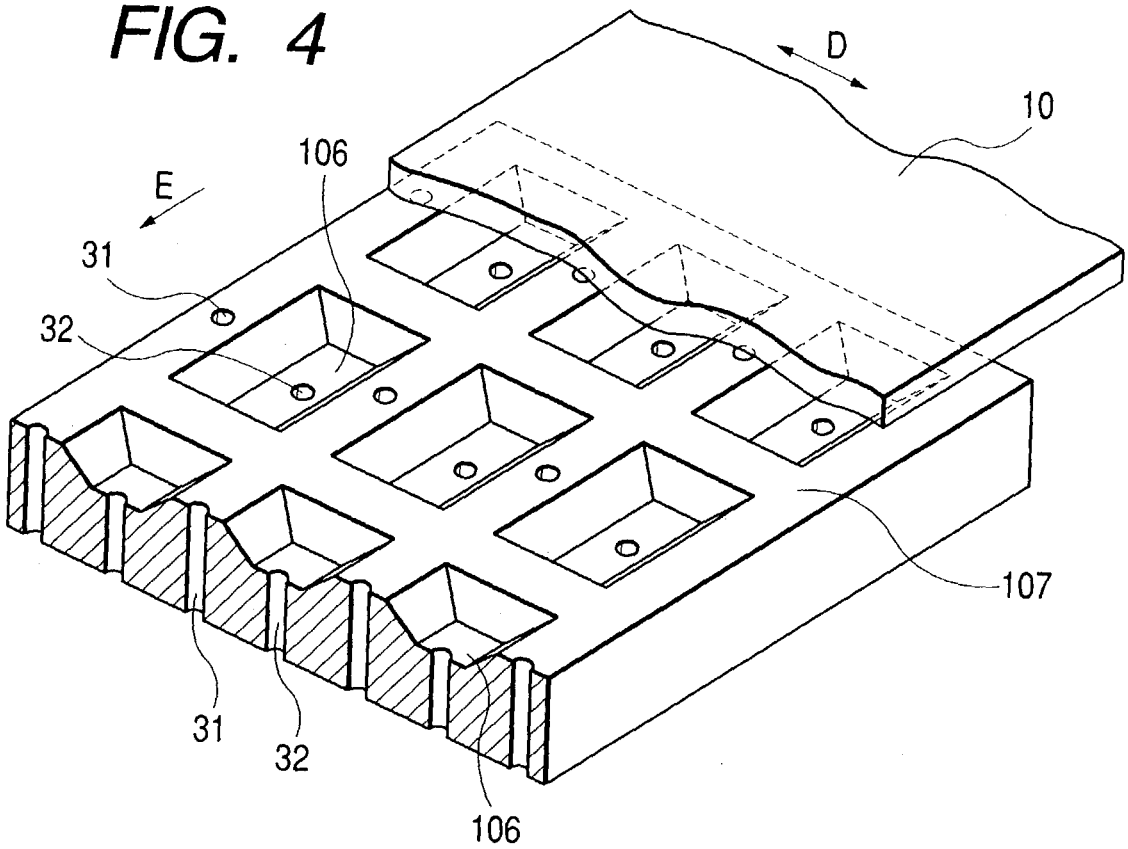
FIG. 4 is a diagram showing a working effect of a suction unit according to a second embodiment.
Figure 5:
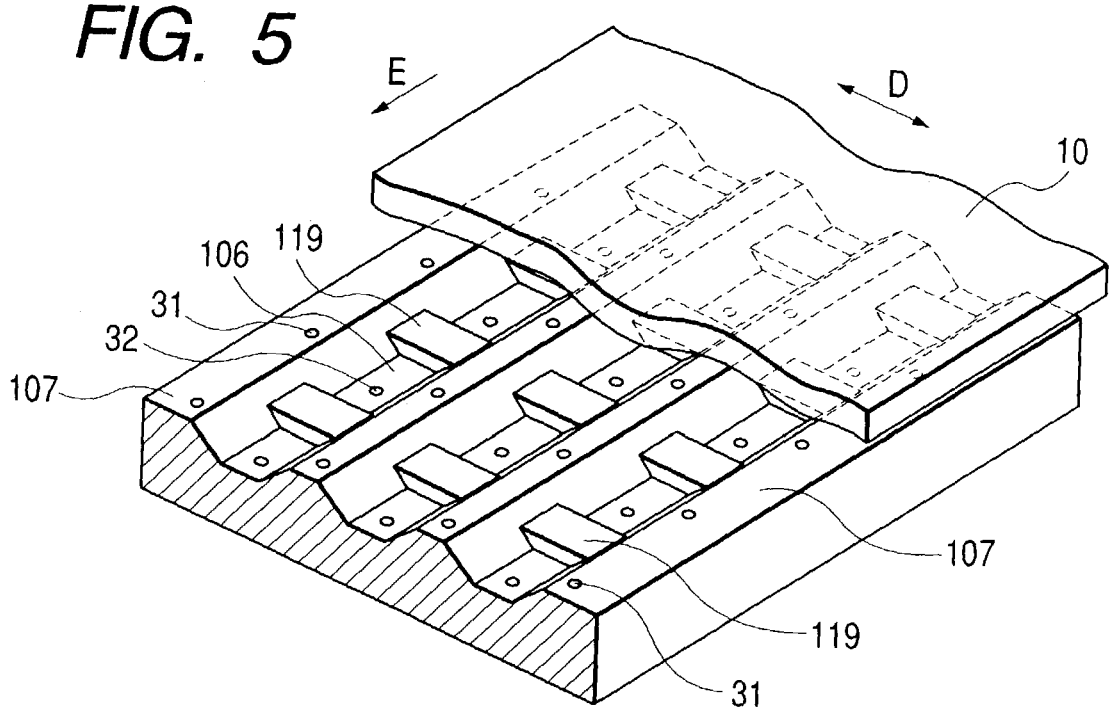
FIG. 5 is a diagram showing a working effect of a suction unit according to a third embodiment.
Figure 6:
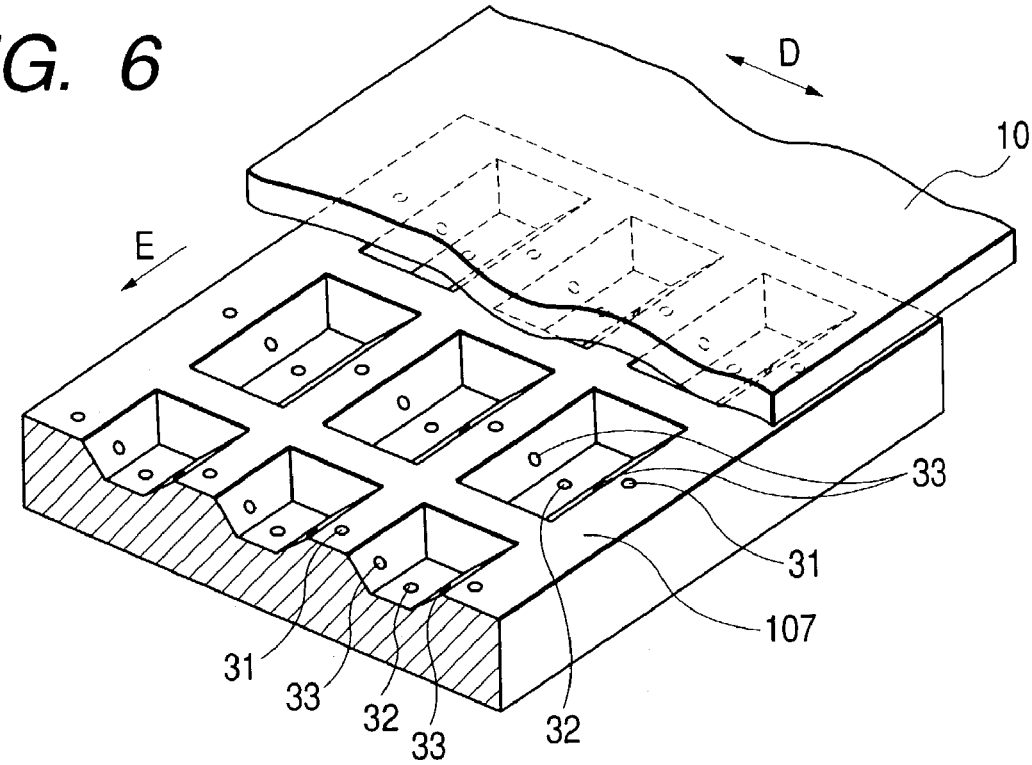
FIG. 6 is a diagram showing a working effect of a suction unit according to a fourth embodiment.

FIG. 2 is a diagram showing a working effect of a previous suction unit 100 as a comparative example, which was developed before the foregoing embodiments of the present invention were accomplished, FIG. 3 is a diagram showing a working effect of the suction unit according to the first embodiment, and FIGS. 4 to 6 are diagrams showing working effects of suction units 100 according to second to fourth embodiments.

Firstly, the working effect of the previously developed suction unit will be described. As shown in FIG. 2, the suction force is expressed by $\Delta P \cdot A1$ ($\Delta P = P0 - P$), in which $\Delta P$ is generated negative pressure, A1 is area of a suction chamber, P0 is external pressure (herein, atmospheric pressure), and P is static pressure of a sucking hole. $\Delta P$ is similar to those of the suction units according to the first and other embodiments. However, since the area of the surface of the sucking hole 31 opposed to the recording medium (sectional area) A1 is smallest, the suction force is small.

When a recording medium 10 absorbs a large quantity of ink, such as ink of solid image, as shown in FIG. 2, portions of the recording medium 10 located above the sucking holes 31 are sucked. However, because the suction force pressing the recording medium downward is weak between other portions than the sucking holes 31 and the recording medium 10, portions of the recording medium located there rise up largely, so that rising-up of the recording medium due to cockling cannot be prevented more effectively.

Next, the working effect of the suction unit according to the first embodiment will be described. As shown in FIG. 3, the suction chamber 106 that is a recess indented from the surroundings is formed in the main scanning direction (in the direction E) between the adjacent sucking holes 31, and the sucking hole 32 is formed in the suction chamber 106. Further, the plural suction chambers 106, sucking holes 32, and sucking holes 31 are similarly arranged also in the sub-scanning direction (in the direction D). The suction force of this suction chamber 106 is expressed by $\Delta P \cdot A2$ ($\Delta P = P0 - P$), in which A2 is area of the suction chamber 106.

$\Delta P = P0 - P$ is similar to those of the conventional suction units 100 and suction units 100 according to other embodiments. However, since the area of the surface of the suction chamber 106 opposed to the recording medium 10 (sectional area) A2 is larger than that in the conventional case, the suction force is large.

When the recording medium 10 is fed on the transporting surface 107, it is sucked firstly by the sucking holes 31 on the transporting surface 107. Next, since the recording medium 10 absorbing a large quantity of ink such as ink of solid image is sucked and absorbed by the sucking holes 31, the occurring cockling falls into the suction chambers 106. Into the suction chamber 106 that becomes in a state of the closed space because the recording medium 10 falls downward, the recording medium is further sucked strongly by its negative pressure. In result, the upper portion of the cockling does not rise up, and the shape of the cockling is corrected into a shape corresponding to the shape of the suction unit. Hereby, size reduction of the suction unit can make a size of wave of the cockling greatly small. It is confirmed that the shapes of the sucking holes 31 and 32 may be approximately circular or approximately polygonal. Further, plural sucking holes 32 may be formed into the suction chamber 106.

Next, the working effects of suction units 100 according to second to sixth embodiments shown in FIGS. 4 to 8B will be described.

As shown in FIG. 4, similarly to in the first embodiment, an approximately rectangular recess that is indented from the surroundings is formed. However, as shown in FIG. 4, side surfaces of the suction chamber 106 are slanted faces descending toward the bottom of the recess. Next, when a recording medium 10 absorbs a large quantity of ink such as ink of solid image, as shown in FIG. 4, it is, similarly to in the first embodiment, sucked and absorbed at the space portion on a transporting surface 107 by the suction force that is weaker than that in the suction chamber 106, into the suction chamber 106 that becomes in the state of the closed space because the recording medium 10 falls downward, the occurring cockling is further sucked strongly by its negative pressure, and the shape of the cockling is corrected into a shape corresponding to a shape of the suction unit 100. Here, by making the side surfaces of the suction chamber 106 the slanted faces, the shape of the suction unit 100 fits to the shape of the cockling, and airtightness between the fixed material 10 and the suction unit 100 is increased, so that suction effect increases more.

As shown in FIG. 5, a partition wall 119 between suction chambers 106 formed on a flat formed transporting surface 107 continuously in the sub-scanning direction E is lower than the transporting surface 107. Thus, the partition wall 119 serves as a protrusion that is lower than the fixed material transporting surface 107. Hereby, when a recording medium 10 closely attached to the transporting surface 107 and the suction chambers 106 is transported in the sub-scanning direction E, its transportation is not obstructed and rising-up of the recording medium from the transporting surface 107 is prevented, such the working effect can be obtained that airtightness between the recording medium 10 and the suction unit 100 is increased.

As shown in FIG. 6, similarly to in the first embodiment, side surfaces of a suction chamber 106 that is a recess are formed slantingly and sucking holes 33 are formed in its slanted faces. When a recording medium 10 absorbs a large quantity of ink such as ink of solid image, as shown in FIG. 6, the recording medium 10 located at the upper portion of the suction chamber 106 is sucked and absorbed similarly to in the first embodiment. Therefore, cockling is easy to fall down into the suction chambers 106. And, the sucking holes 33 formed on the slanted faces suck the cockling auxiliarily, and work so as to guide the bottom of the cockling to the sucking hole 32 located at the bottom of the suction chamber 106. Hereby, the upper portion of the cockling does not rise up, and the shape of the cockling is corrected into a shape corresponding to the shape of the suction unit 100.

Figure 7:
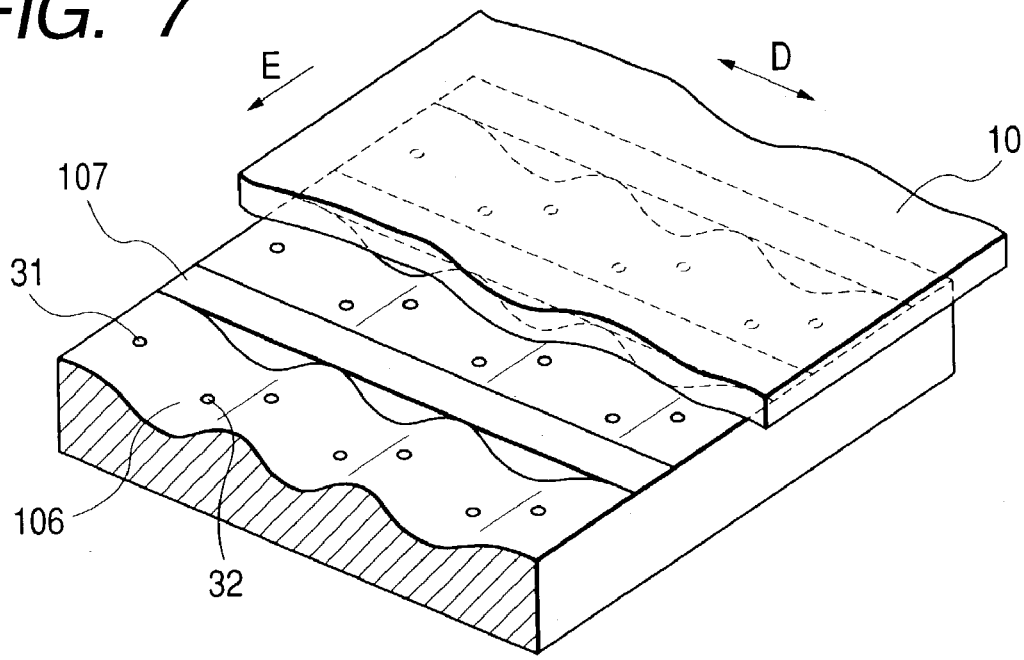
FIG. 7 is a diagram showing a working effect of a suction unit according to a fifth embodiment.

As shown in FIG. 7, similarly to in the first embodiment, suction chambers 106 that are recesses are formed on a transporting surface 107. However, its recess comprises a concave curved surface and is formed continuously. This recess has the approximately same shape as cockling occurring in a recording medium 10. By forming the recess in the approximately same shape as the cockling, as shown in FIG. 7, airtightness between the recording medium 10 and a suction unit 100 is increased, so that there is a working effect that the cockling does not rise up.

Figure 8A:
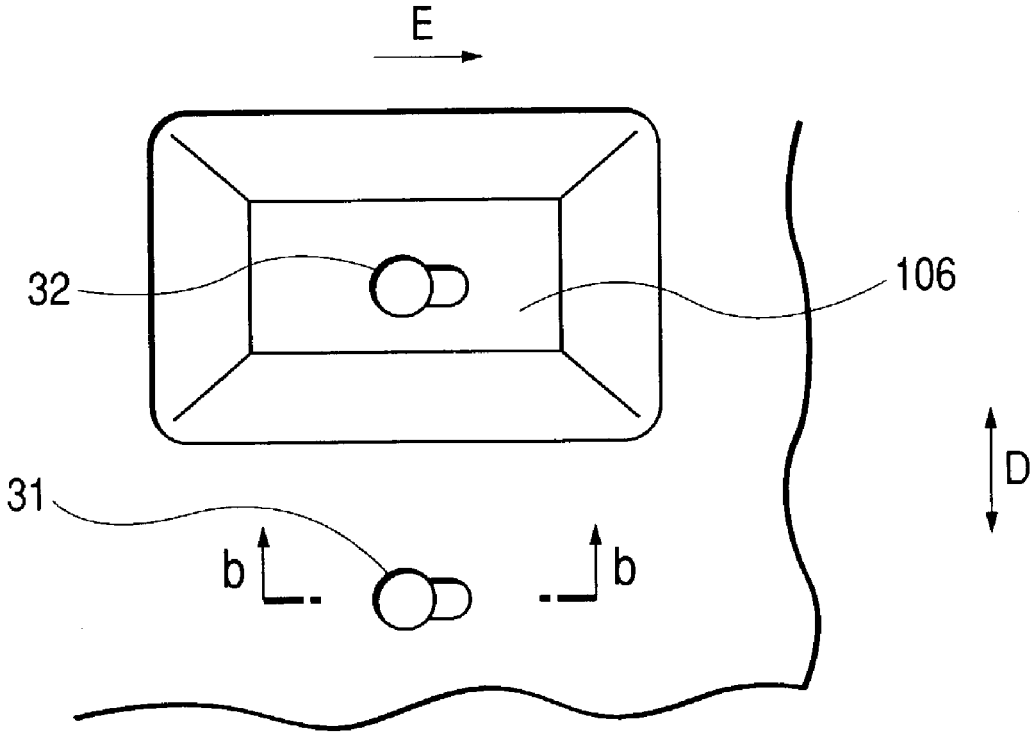
Figure 8B:
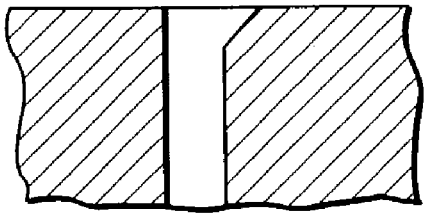

FIGS. 8A and 8B are diagrams showing the shape of a sucking hole 31 on a transporting surface 107, in which FIG. 8A is its plan view and FIG. 8B is its sectional view. As shown in FIGS. 8A and 8B, an edge of an outer sucking hole 31 located outside the recess is chamfered on its downstream side in the sub-scanning direction E that is a transporting direction of a recording medium. Hereby, when the recording medium passes on the sucking hole 31 on the transporting surface 107, the recording medium is transported without being caught at its leading end. Further, in case that a sucking hole 32 inside a suction chamber 106 is also chamfered similarly, the similar working effect can be obtained.

Figure 9:
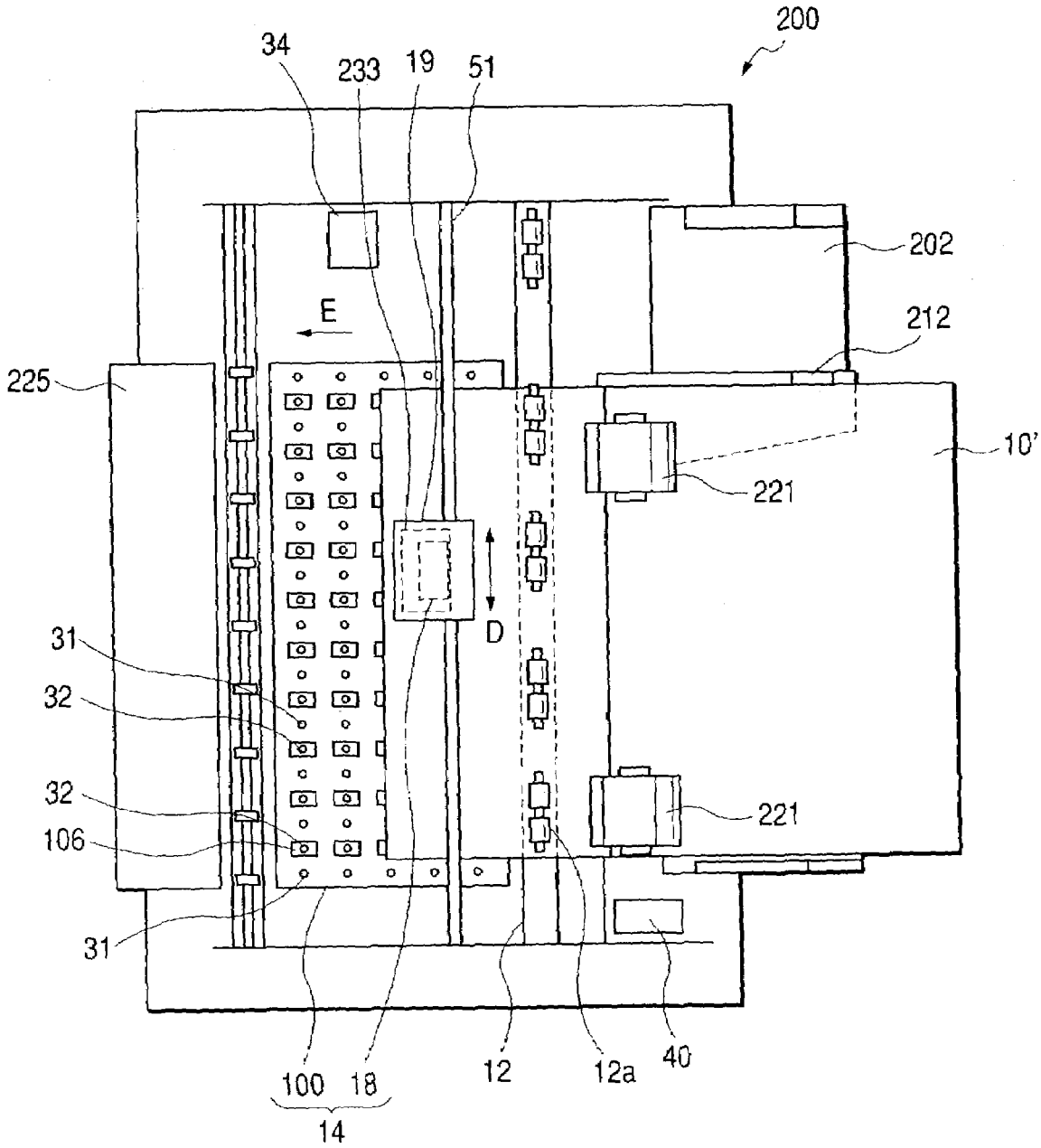
FIG. 9 is a schematic plan view showing one embodiment of an ink jet printer as a liquid fixing apparatus to which the invention is applied.
Figure 10:
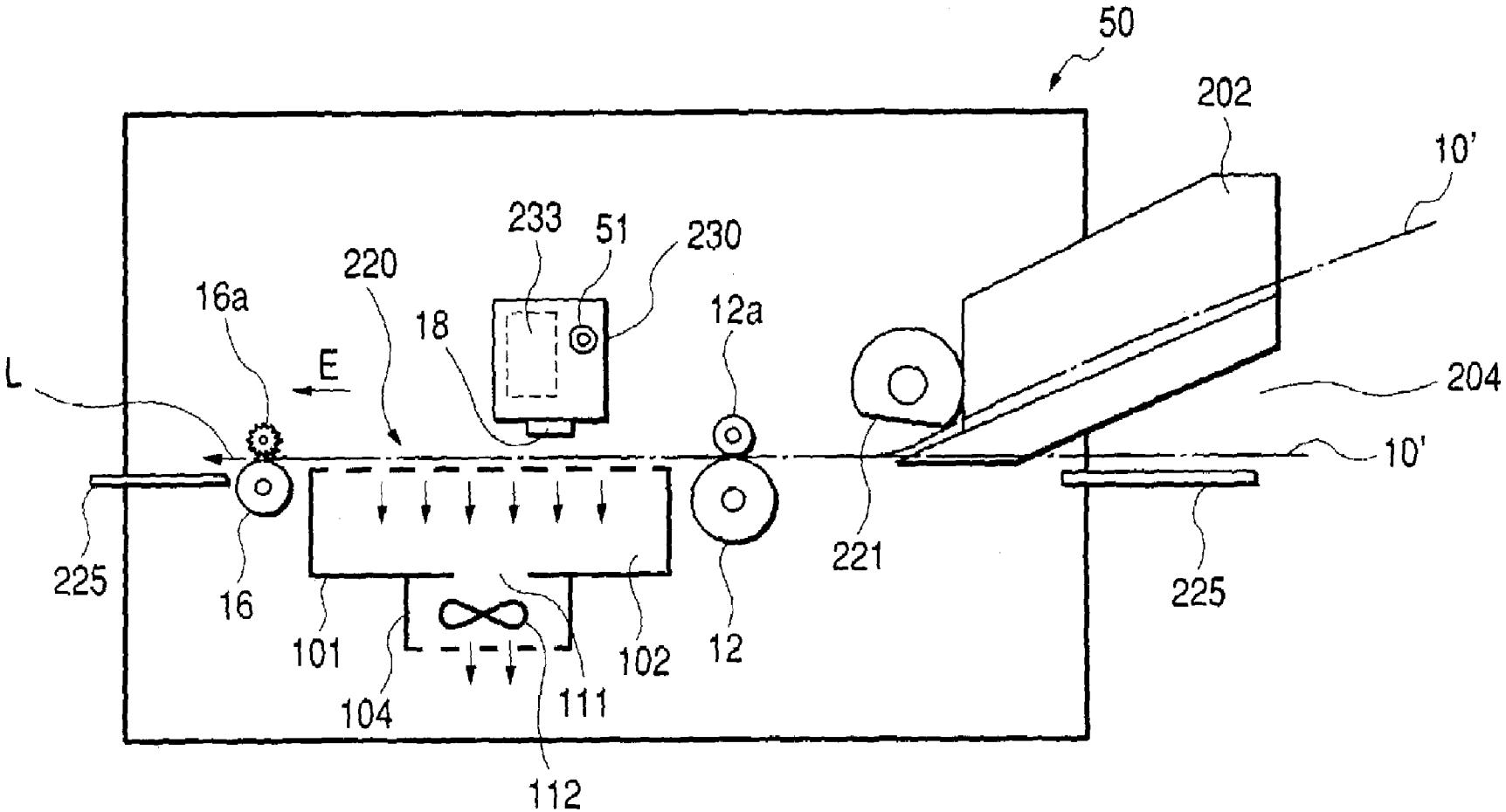
FIG. 10 is a schematic side view showing the embodiment of the ink jet printer as a liquid fixing apparatus to which the invention is applied.

FIG. 9 is a schematic plan view showing one embodiment of an ink jet printer that is a liquid fixing apparatus to which the invention is applied, and FIG. 10 is a side view thereof.

As shown in FIG. 9, in this ink jet printer, basically, recording sheets 10' stored onto a sheet tray 212 of an automatic sheet feeding unit 202 (ASF) slantingly attached to a printer body 200 are fed to a recording unit 14 comprising a recording head 18 and a suction unit 100 located below the recording head 18 by a recording medium transportation apparatus 50 that transports the recording sheet in the transporting direction D at the recording, and the recording sheet 10' on which data has been recorded is discharged to the outside of the printer body 200. However, a manual sheet feeding port 204 (refer to FIG. 10) not shown in FIG. 9 is formed on the backside of the printer body 200, the recording sheet 10' inserted from this manual sheet feeding port 204 is fed similarly to the recording unit 14 by the recording medium transportation apparatus 50 at the recording, and the recording sheet 10' on which data has been recorded is discharged to the outside of the printer body 200. As a recording sheet 10', various paper can be used, for example, dedicated paper for ink jet printer, plain paper, an OHP film, tracing paper, a postcard, and the like.

The recording medium transportation apparatus 50 includes the suction unit 100 that sucks and holds the recording sheet 10' at the recording, and a recording medium transporting device that transports the recording sheet 10' from the upstream side of the suction unit 100 to the downstream side thereof.

The recording medium transporting device comprises a sheet supply roller 221 for picking up and feeding out the recording sheets 10' stored onto the sheet tray 212 one by one, a sheet feeding roller 12 and its driven roller 12*a* that feed the recording sheet 10' between the recording head 18 and the suction unit 100, and a sheet discharging roller and a spur roller 16*a* functioning as its driven roller that discharge the recording sheet 10' on which data has been recorded to the outside of the recording unit 14. Further, in FIG. 10, an arrow L represents a transporting path of the recording sheet 10' transported by the recording medium transportation apparatus 50.

The recording head 18 is mounted on a carriage 230 supported slidably by a guide shaft 51 provided in parallel in the direction D (main scanning direction) orthogonal to the transporting direction E (sheet feeding direction or sub-scanning direction) of the recording sheet 10'. This carriage 230 slides on the guide shaft 51 by a timing belt driven by a carriage drive motor 40. And, the recording head 18 has nozzle arrays comprising plural nozzles such as 96 nozzles for each color, and ink for each color supplied from an ink cartridge 233 detachably attached to the carriage 230 is ejected on the recording sheet 10' according to print data from all or part of the plural nozzles as a minute ink droplet.

The suction unit 100 is arranged in a position opposed to the recording head 18 with the transporting path L of the recording sheet 10' between, comprises a suction part 101 in an upper step and a suction force generating part 104 in a lower step, and is formed in the shape of a hollow box. The suction part 101, as shown in FIG. 10, comprises a decompression chamber 102 formed inside, plural suction chambers 106 (sectional area S3) that are respectively formed in the shape of an approximately rectangular recess on a transporting surface 107 of the recording sheet 10', and plural sucking holes 32 (sectional area S1) arranged vertically so as to communicate these suction chambers 106 with the decompression chamber 102. In this embodiment, the suction chamber 106 is formed so that the area S3 of the suction surface opposed to the recording sheet 10' is larger than the sectional area S1 of the sucking hole 32. The suction force generating part 104 communicates with the decompression chamber 102 of the suction part 101 through a communication hole 111, and includes a pump 112 having a centrifugal fan. The pump 112 is attached in the predetermined position below the decompression chamber 102 in a state where it communicates with the decompression chamber 102 through a communication hole 111, and the centrifugal fan is operated at the recording. In this embodiment, the pump 112 of the suction unit 100 is always rotating, intake force by the pump 112 acts on the sucking hole 32, the suction chamber 106, and the sucking hole 31 through the communication hole 111 and the decompression chamber 102, so that they come to the intake and suction state.

When a recording instruction to the recording sheet 10' stored onto the sheet tray 212 is input by a not-shown host computer, the sheet supply roller 221 of the ASF unit 202 is driven and rotated, and picks up and feeds out the recording sheets 10' stored onto the sheet tray 212 one by one. Further, the sheet feeding roller 12 is driven and rotated by driving force of a stepping motor, and transports the recording sheet 10' so as to feed it between the recording head 18 and the suction unit 100.

Next, the recording sheet 10' fed into the recording unit 14 is sucked and absorbed on a recording medium transporting surface 107 of the suction unit 100, and transported in a state where the recording sheet is closely attached to the transporting surface. Simultaneously, while the recording head 18 is moving above the recording sheet 10' in the main scanning direction (in the direction D), it ejects ink droplets onto the recording sheet 10' to perform image recording. After this image recording has been completed, the recording sheet 10' is fed out from the recording unit 14 by the discharging roller 16 and the spur roller 16*a* functioning as a driven roller or it is fed out from the recording unit 14 by the movement of the suction unit 100. Thereafter, the recording sheet 10' is discharged to the outside of the printer. At this time, as described above, since rising-up due to the cockling is not produced in the recording sheet 10, even if the spur roller 16*a* is used, spur traces are not given.

Figure 11:
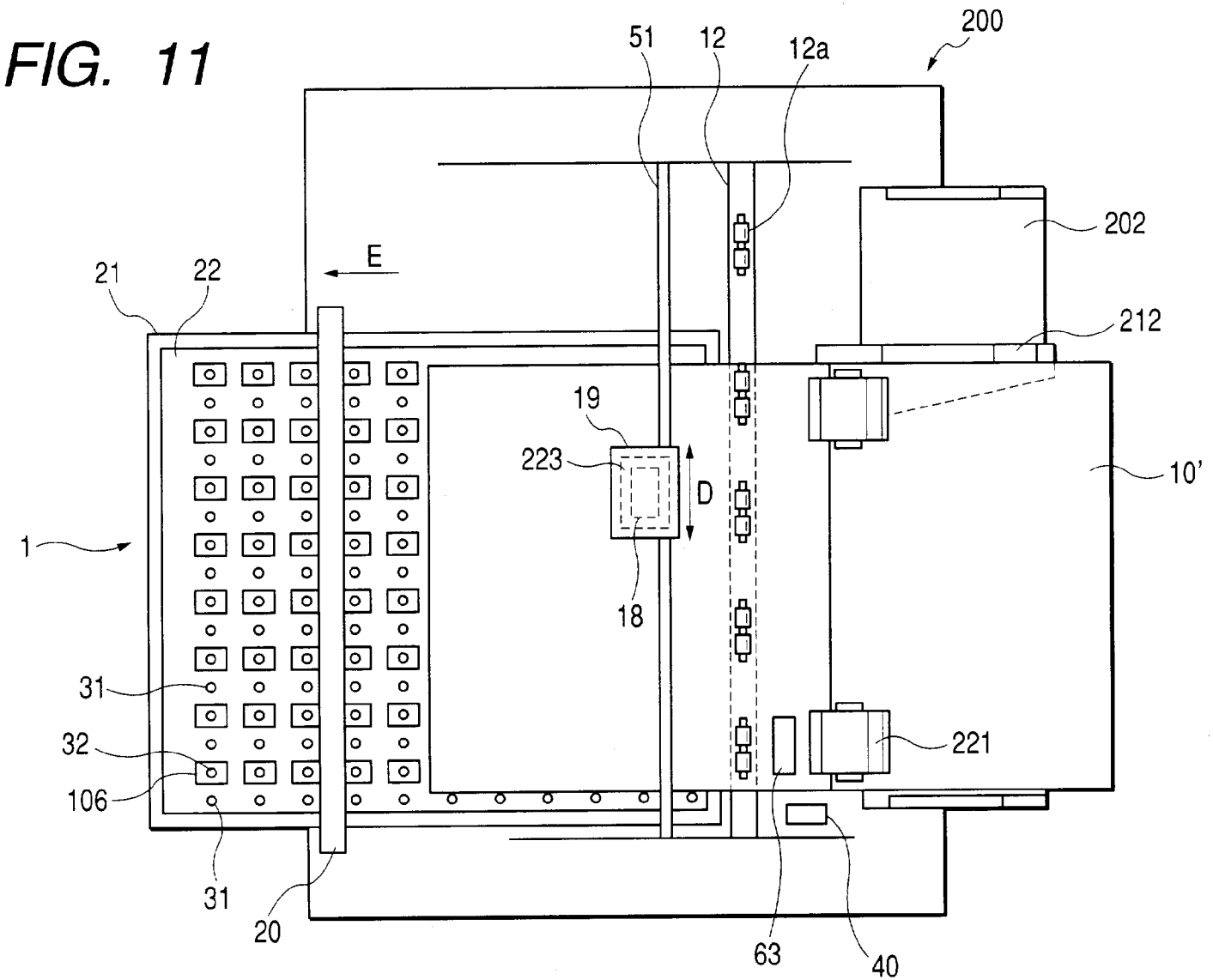
FIG. 11 is a schematic plan view showing another embodiment of an ink jet printer as a liquid fixing apparatus to which the invention is applied.
Figure 12:
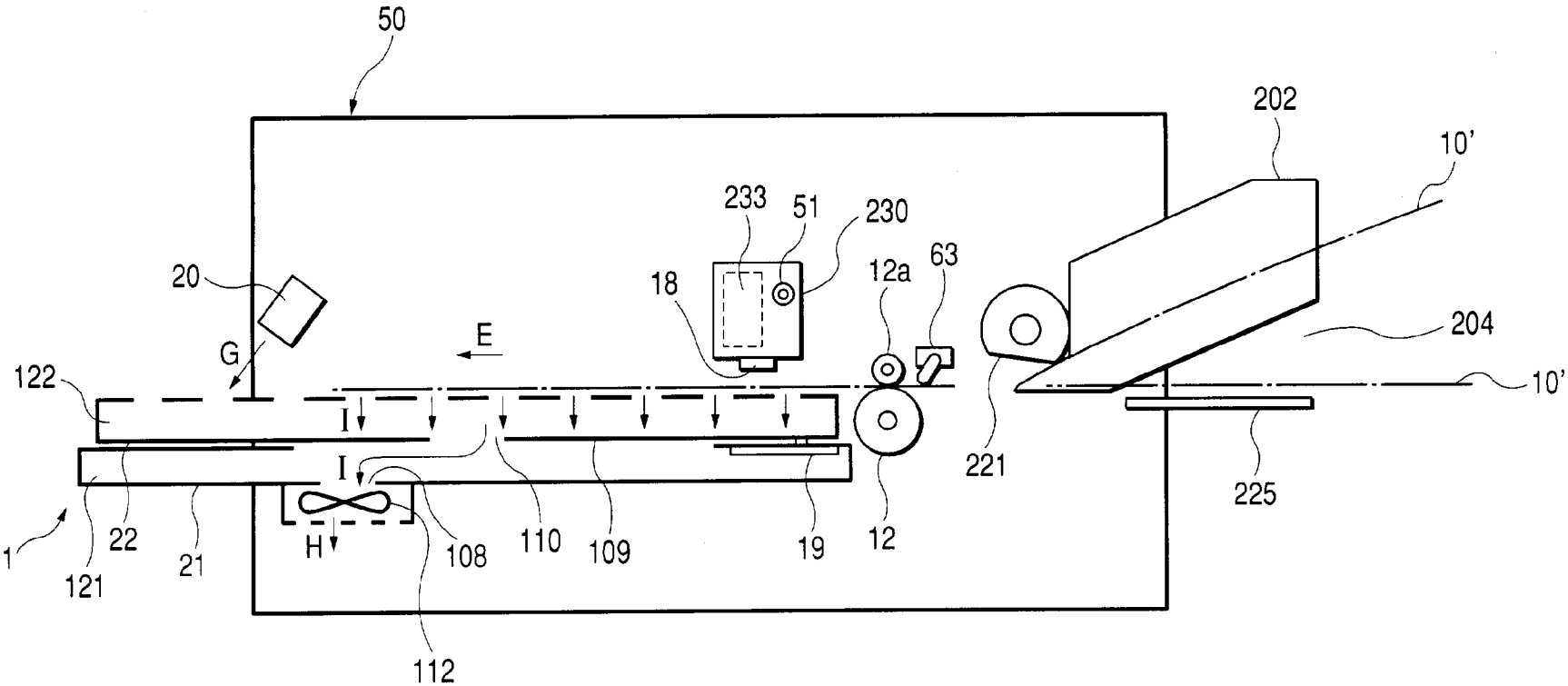
FIG. 12 is a schematic side view showing another embodiment of an ink jet printer as a liquid fixing apparatus to which the invention is applied.

As another embodiment, the suction unit 100 is constituted movably in the discharging direction, whereby sheet discharge may be performed without providing the discharging roller 16 and the spur roller 16*a* in FIGS. 9 and 10. Another embodiment of the ink jet printer as a recording apparatus is shown in FIGS. 11 and 12. FIG. 11 is a schematic plan view showing another embodiment of the recording medium transportation apparatus, and FIG. 12 is its side view. Further, parts similar to those previously described in the first embodiment of the ink jet printer as the recording apparatus are denoted by the same reference numerals and their description is omitted.

A printer body 200 functioning as a recording medium transportation apparatus includes a movable suction/sheet discharging unit 1 functioning as a unit for discharging the recorded recording sheet 10'. The suction/sheet discharging unit 1 comprises a fixed table 21, a movable table 22, a pump 112 including a centrifugal fan as a decompression unit, and a release nozzle 20. By this suction/sheet discharging unit 1, the recording sheet 10' is moved and discharged in the sub-scanning direction E.

The fixed table 21 has a first decompression chamber 121 having a hollow structure, arranged in a state where it is fixed to the recording medium transportation apparatus 50 body, and has a pump 112 at its bottom. The pump 112 communicates with the first decompression chamber 121 through a first communicating hole 108. The pump 112 rotates, whereby air in the first decompression chamber 121 is sucked in the direction of an arrow H, and the inside of the first decompression chamber 121 is pressure-reduced. Further, on the upper surface of the fixed table 21, a second communication hole 109 communicating with the first decompression chamber 121 is formed.

The movable table 22 has a second decompression chamber 122 having a hollow structure, and arranged so that it can slide on the fixed table 21 in the sub-scanning direction E. Further, at the bottom of the movable table 22, a third communication hole 110 communicating with the second decompression chamber 122 is formed. Further, on the upper surface of the movable table 22, in addition to a sucking hole 31 communicating with the second decompression chamber 122, a sucking hole 32 is formed in a suction chamber 106, and the sucking hole 32 consists of a through hole having the small diameter. In a state where the second communication hole 109 and the third communication hole 110 communicate with each other as shown by an arrow I, the recording sheet 10' is sucked to the sucking holes 31 and 32 on the movable table as shown by an arrow J, so that the recording sheet 10' is absorbed and held on the upper surface of the movable table 22.

The release nozzle 20 releases air sucked by the pump 112 through a not-shown flowing passage. By air flow released from the release nozzle 20, the recorded recording sheet 10' on the movable table 22 is discharged to the not-shown discharge tray.

Between a sheet supply roller 221 and a sheet feeding roller 12, a sheet sensor 63 based on the known technology is arranged. The sheet sensor 63 is provided with a habit of self-return to a standing posture, and includes a lever supported in a state where it protrudes in the transporting passage of the recording sheet 10' so as to rotate only in the recording sheet transporting direction. The leading end of this lever is pressed against the recording sheet 10', whereby the lever rotates thereby to detect the recording sheet 10'.

The recording sheet 10' is transported by the recording sheet transporting device in the sub-scanning direction E by the predetermined transporting amount. When the end of the recording sheet 10' passes through the recording sheet transporting device, in case that recording on the recording sheet has not completed yet, the recording sheet is sequentially transported by the sheet discharging apparatus in the sub-scanning direction E by the predetermined transporting amount. Further, the sheet sensor 63 is arranged closer to the upstream side in the sub-scanning direction than a recording execution region. Therefore, after the end of the recording sheet passed through the sheet sensor 63, it passes through the recording sheet transporting device. Therefore, when the end of the recording sheet is detected by the sheet sensor 63 and it has passed through the sheet sensor 63, or after the recording sheet has passed through the sheet sensor 63 and then the recording sheet has been transported by the predetermined amount, the sheet discharging operation is started. Hereby, when the end of the recording sheet has passed through the recording sheet transporting device, the recording sheet does not become free but it can be sequentially transported surely by the sheet discharging apparatus.

Further, in the recording medium transportation apparatus 50, a platen that defines a gap between a head surface of the recording head 18 and the recording sheet 10' is not arranged, but the movable table 22 functions also as a platen.

Next, operations from recording on the recording sheet 10' to sheet discharge will be described.

The operation of ejecting ink onto the recording sheet 10' while the carriage 233 is being reciprocated in the main scanning direction D by the timing belt driven by a carriage drive motor 40, and the operation of transporting the recording sheet 10' in the sub-scanning direction E by the sheet feeding roller 12 and its driven roller 12*a* are alternately executed, so that recording is performed on the recording sheet 10'. In the embodiment, the pump 112 keeps sucking the recording sheet 10' on the movable table 22 in a state where the pump 112 always rotates. Therefore, the recording sheet 10' on the movable table 22 is always sucked from the sucking hole 31 and the sucking hole 32, and sucked and held on the movable table 22. Hereby, while the recording sheet 10' is being sucked on the movable table 22, it is transported sliding on the movable table 22. Therefore, the rising-up of the recording sheet 10' due to the cockling can be prevented, whereby the gap between the recording sheet 10' and the head surface of the recording head 18 can be always kept constant.

When the end of the recording sheet 10' has passed firstly through the sheet sensor 63, and then it has separated from the sheet feeding roller 12 and its driven roller 12*a*, the movable table 22 starts moving in the sub-scanning direction E. This timing can be determined by a detection timing at which the end of the recording sheet 10' passes through the sheet sensor 63 and by the distance from the sheet sensor 63 to the sheet feeding roller and its driven roller 12*a*. Thereafter, the recording sheet 10', by the movable table 22, is sequentially transported in the sub-scanning direction E intermittently, and the residual recording is executed onto the recording sheet 10'.

While the recording sheet 10' is, by the movable table 22, being transported in the sub-scanning direction E, recording is executed in the vicinity of its end. At this time, in case that recording is executed at the end of the recording sheet 10' without space, extra ink is dropped into an ink absorber 19 arranged on the upper surface of the fixed table 11, and recording is executed at the end of the recording sheet 10'. Hereby, since the ink can be dropped into the wide region, when recording is executed at the end of the recording sheet 10' without space, ink can be ejected from all the nozzle arrays of the recording head 18 to perform recording. Hereby, through put in case that recording is executed at the end of the recording sheet 10' without space can be improved.

When the movable table 22 further moves in the sub-scanning direction E, a part of the second communicating hole 109 is opened to the outside. Hereby, mist-like ink floating in air in the recording execution region by the recording head 18, so-called ink mist can be sucked. Therefore, it is possible to prevent deterioration of recording quality caused by adhesion of the ink mist onto the recording surface of the recording sheet 10'.

When recording on the recording sheet 10' has been completed and the movable table 22 further moves in the sub-scanning direction E, communication between the second communication hole 109 and the third communication hole 110 is shut off. Hereby, the suction from the sucking holes 31 and 32 is stopped, and the recording sheet 10' is not sucked and held on the movable table 22, that is, it is only placed there. Next, the release nozzle 20 releases air sucked from the pump 112 toward the recording sheet 10' in the direction of an arrow G, and its air pressure transports the recording sheet 10' on the movable table 22 to the not shown discharge tray. Then, the movable table 22 is moved to a position shown in FIG. 3 to make the next recording possible.

Further, also during execution of recording, the air may keep being released from this release nozzle 20, whereby the force by which the recording sheet 10' is pressed against the movable table 22 from the recording surface side can be applied. Therefore, the rising-up of the recording sheet 10' can be further suppressed. And, when the suction from the sucking holes 31 and 32 stops and the recording sheet 10' enters to a state where it is not sucked and absorbed on the movable table 22, the recording sheet 10', by the air flow from the release nozzle 20, is discharged to the not shown discharge tray.

As described above, the ink jet recording apparatus 50 according to the invention includes the suction/sheet discharging unit 1 that can discharge the recording sheet 10' without coming into the recording surface of the recording sheet 10'. Therefore, fear that the recording quality of the recording surface is damaged can be reduced.

The invention is not limited to the above embodiments, but various modifications are possible in the invention without departing from the scope of the claims, and they are also included in the scope of the claims of the invention.

According to the invention, since the outer sucking holes as well as the inner sucking holes are provided, the large suction force can be obtained, so that the rising-up due to the cockling of the recording medium can be effectively prevented.

Further, since the rising-up of the recording medium can be prevented, the paper gap can be made small, whereby printing accuracy can be improved, and a very high quality image can be obtained in the dedicated paper where the cockling is difficult to occur.

Further, since the shape of the cockling is corrected into the shape corresponding to the shape of the suction unit, the wavy of the cockling itself can be made greatly small.

In addition, since it is possible to prevent the recording medium from rising up and it is possible at least to depress the recording medium, the recording medium is not pressed against the spur roller, so that the spur traces are not given onto the recording medium (even if the spur roller is used).

As described above, in the recording apparatus, the rising-up of the recording medium due to the cockling can be suppressed, and the proper paper gap can be set, whereby recording having the high quality image can be performed on the recording medium.

What is claimed is:

1. A medium transportation apparatus comprising:

a suction unit that sucks and holds a medium on a transporting surface;

a transporting device that transports the medium on the transporting surface from an upstream side of the suction unit to a downstream side thereof;

wherein a plurality of recesses indented from a circumference thereof are aligned in a main scanning direction on the transporting surface;

wherein an inner sucking hole is formed in the plurality of recesses;

wherein an outer sucking hole is formed at least between the plurality of recesses in the main scanning direction on the transporting surface, and wherein at least one of the plurality of recesses has a slanted face descending from the transporting surface toward the bottom of the recess.

2. A medium transportation apparatus according to claim 1, wherein a sucking hole is formed in at least one of the slanted faces.

3. A medium transportation apparatus according to claim 1, wherein the recesses have, in the sub-scanning direction, at least one protrusion that is lower than the transporting surface.

4. A medium transportation apparatus according to claim 1, wherein at least one of the recesses of the transporting surface has a curved surface.

5. A medium transportation apparatus according to claim 1, wherein at least one of the sucking holes on the transporting surface is chamfered at least on a downstream side thereof in the sub-scanning direction.

6. A liquid fixing apparatus including the medium transportation apparatus according to any one of claims 1 to 5.

7. The medium transportation apparatus according to claim 1, wherein each of the plurality of recesses is separated by a partition wall which is lower than the transporting surface.

8. The fixed material transportation apparatus according to claim 1, wherein the inner sucking holes and the outer sucking holes are provided over a recording area in which liquid fixing is performed on the medium, and wherein the inner sucking holes and the outer sucking holes are also provided in an area located downstream of the recording area.

9. A medium transportation apparatus comprising:

a suction unit that sucks and holds a medium on a transporting surface;

a transporting device that transports the medium on the transporting surface from an upstream side of the suction unit to a downstream side thereof;

wherein a plurality of recesses indented from a circumference thereof are aligned in a main scanning direction on the transporting surface;

wherein an inner sucking hole is formed in the plurality of recesses;

wherein an outer sucking hole is formed at least between the plurality of recesses in the main scanning direction on the transporting surface, and wherein each of the plurality of recesses form a concave curved surface which is formed continuously in the main scanning direction of the transporting surface.

10. A medium transportation apparatus comprising:

a suction unit that sucks and holds a medium on a transporting surface;

a transporting device that transports the medium on the transporting surface from an upstream side of the suction unit to a downstream side thereof;

a plurality of recesses, each having a closed shape, are indented from the transporting surface;

an inner sucking hole formed in each of the recesses;

an outer sucking hole formed on the transporting surface, and corresponding to each inner sucking hole, such that each inner sucking hole and corresponding outer sucking hole are adjacent to each other, the recesses are aligned perpendicular to a main scanning direction, and wherein at least one of the plurality of recesses has a slanted face descending from the transporting surface toward the bottom of the recess.

11. The transportation apparatus according to claim 1, wherein the inner sucking holes are aligned with the outer sucking holes in the main scanning direction.

12. The medium transportation apparatus according to claim 10, wherein each inner sucking hole is aligned with the corresponding outer sucking hole in the main scanning direction.

13. The medium transportation apparatus according to claim 10, wherein each inner sucking hole and the corresponding outer sucking hole are provided over a recording area in which liquid fixing is performed on the medium, and wherein each inner sucking hole and the corresponding outer sucking hole are also provided in an area located downstream of the recording area.

14. The medium transportation apparatus according to claim 10, wherein the inner sucking holes and the outer sucking holes are alternately formed in the main scanning direction.

15. A medium transportation apparatus comprising:

a suction unit that sucks and holds a medium on a transporting surface;

a transporting device that transports the medium on the transporting surface from an upstream side of the suction unit to a downstream side of the suction unit;

wherein:

a plurality of recesses, each having a closed shape and extending perpendicular to the main scanning direction, are indented from the transporting surface, and are aligned in a main scanning direction on the transporting surface;

inner sucking holes are formed in the plurality of recesses;

outer sucking holes are formed at least between the plurality of recesses in the main scanning direction on the transporting surface; and wherein at least one of the plurality of recesses has a slanted face descending from the transporting surface toward the bottom of the recess.

* * * * *